US006641065B2

(12) United States Patent
Bardos et al.

(10) Patent No.: US 6,641,065 B2
(45) Date of Patent: Nov. 4, 2003

(54) WOOD PROCESSING SYSTEMS AND METHODS OF CONSTRUCTING AND USING THEM

(75) Inventors: Gary M. Bardos, Weidman, MI (US); Michael L. Hockstra, Edmore, MI (US)

(73) Assignee: Morbark, Winn, MI (US)

( * ) Notice: Subject to any disclaimer, the term of this patent is extended or adjusted under 35 U.S.C. 154(b) by 0 days.

(21) Appl. No.: 10/141,887

(22) Filed: May 9, 2002

(65) Prior Publication Data

US 2002/0125356 A1 Sep. 12, 2002

Related U.S. Application Data

(62) Division of application No. 09/716,532, filed on Nov. 20, 2000, now Pat. No. 6,474,759.
(60) Provisional application No. 60/170,043, filed on Dec. 10, 1999.

(51) Int. Cl.[7] ..... B02C 13/30
(52) U.S. Cl. ..... 241/30; 241/88.4; 241/186.35; 241/285.2; 29/428
(58) Field of Search ..... 241/88.4, 186.35, 241/285.2; 29/428; 241/30

(56) References Cited

U.S. PATENT DOCUMENTS

| | | | |
|---|---|---|---|
| 27,154 | A | 2/1860 | Powers |
| 384,414 | A | 6/1888 | Bartholomew |
| 1,975,406 | A | 10/1934 | Reschke |
| 2,076,025 | A | 1/1937 | Hazle, Jr. |
| 4,056,107 | A | 11/1977 | Todd et al. |
| 4,193,556 | A | 3/1980 | Linnerz et al. |
| 4,625,924 | A | 12/1986 | Killinger |
| 4,771,953 | A | 9/1988 | Morey |
| 5,213,273 | A | 5/1993 | Linnerz |
| 5,265,811 | A | 11/1993 | Willibald |
| 5,472,146 | A | 12/1995 | Doppstadt |
| 5,472,147 | A | 12/1995 | Doppstadt |
| 5,484,110 | A | 1/1996 | Doppstadt |
| 5,503,339 | A | 4/1996 | Doppstadt |
| 5,503,340 | A | 4/1996 | Doppstadt |
| 5,713,525 | A | 2/1998 | Morey |
| 5,947,395 | A | 9/1999 | Peterson et al. |
| 6,189,820 | B1 | 2/2001 | Young |

FOREIGN PATENT DOCUMENTS

DE 0212194 A1 4/1987

OTHER PUBLICATIONS

Bibbigard Safety Element Torque Limiters pp. 12–14.

*Primary Examiner*—Mark Rosenbaum
(74) *Attorney, Agent, or Firm*—Reisign, Ethington, Barnes, Kisselle & Learman, P.C.

(57) ABSTRACT

A generally horizontal wood comminuter has a crosswise rotor with comminuting knives moving in a path of rotation and a crosswise coacting anvil. A feed works provides a material support surface and a power-driven feed member above it for feeding material toward the rotor. The rotor is driven in an uphill path of rotation relative to the feed works. Lift arms pivotally carry the feed member for swinging vertical movement toward and away from the material support surface. A crosswise deflector plate is carried independently of the lift arms and extends toward the anvil and a crosswise lift arm plate coacts with the deflector plate to contain fragmented material. The anvil and a grate retainer preferably are pivotal to move together from an operative to an inoperative position. A torque limiting device controls the drive of the rotor.

6 Claims, 10 Drawing Sheets

M
O
39
31
77a
38a
37
75
76
47
38
38b
22b
21
22
23
46
38c
49
50
38d
X
40
45
51
26
52
27
28
74
67
26a
29
24
30
36a
32
36
53
42
43
33
G
52
34
35
68
44
F
C
17

FIG-9
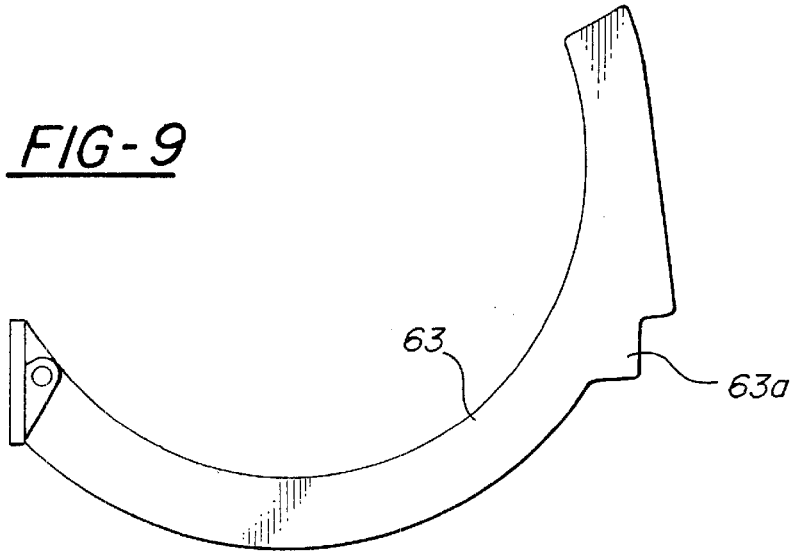
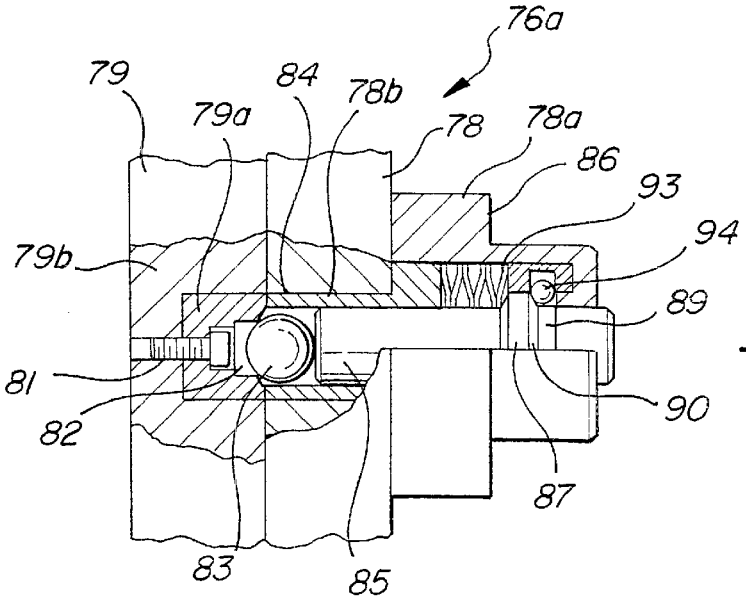
FIG-11
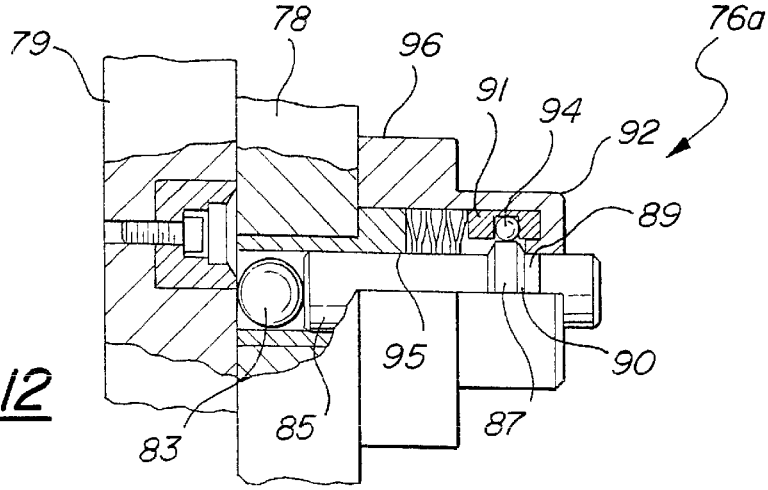
FIG-12

WOOD PROCESSING SYSTEMS AND METHODS OF CONSTRUCTING AND USING THEM

This application is a division of U.S. application Ser. No. 09/716,532 filed Nov. 20, 2000, now U.S. Pat. No. 6,474,579.

This application claims the priority of provisional application Ser. No. 60/170,043 filed Dec. 10, 1999, which is identically entitled. This invention relates particularly to machines known commercially as "wood hogs" for recycling heavy wood material, such as old railroad ties, the heavy pallets used widely in industry, the structural timbers which remain from the demolition of old buildings, heavy wood scrap, and many other such items. Horizontally fed machines of this character are in wide use and a machine of this type is the subject of U.S. Pat. Nos. 4,771,953 and 5,713,525, which are owned by the applicant's assignee and are incorporated herein by reference.

BACKGROUND OF THE INVENTION

It is to be understood that machines of this general character, which are in wide use today for recycling heavy wood products particularly, are of a portable nature in the sense that they can be drawn by tractors or may be self-propelled, can weigh up to 100,000 pounds, and may be up to 50 feet in overall length. Normally such machines, which employ heavy knifed hammers to demolish the wood, are powered by heavy duty diesel engines providing as much as 800–1,000 horsepower.

SUMMARY OF THE INVENTION

The present wood processing system incorporates a rotary drum having a plurality of peripherally supported comminuting members or hammers. Both uphill and downhill rotors are known and in use, and the machine depicted is an uphill rotor machine in which the rotor moves the material upwardly with respect to the horizontal feed of the material. An anvil is supported near the upper end of the machine just upstream of a grating system which facilitates easy maintenance and the ready changing of grates to provide a considerable selection of grate opening sizes and configurations. The material feed system includes a compression feed drum associated with a horizontal conveyor at the entrance to the comminuting drum or rotor and both are driven in a direction to move material to the comminuting drum. The present invention is concerned with various improvements in machines of this character. One of these involves the use of the downwardly swinging compression feed roll to facilitate upward swinging movement of the anvil and upper grate retainer member for maintenance and clearing purposes.

Another improvement is concerned with utilizing a comminuting drum shaft release system which prevents foreign objects, such as heavy metal bolts and fragments from damaging the machine. Still another improvement is concerned with the general construction of the machine including the stacked mounting of the comminuting drum drive shaft and the pivot shaft for the compression feed roll, and a top wall containment deflector plate which is separate from the compression feed roll assembly and pivots with the anvil.

A prime object of the present invention is to provide a rugged heavy duty machine, which can be economically operated at chosen locations, which might be at a landfill, or in the field at a demolition site.

A further object of the invention is to provide a safer machine which confines the material and does not throw it out in the manner that so-called horizontal tub grinders do.

A still further object of the invention is to provide a machine which is particularly designed to handle heavy waste wood material in an effective manner, while, at the same time, being so constructed as to be capable of being economically manufactured and sold at an economically attractive price.

Other object and advantages of the invention will become apparent with reference to the accompanying drawings and the accompanying descriptive matter.

GENERAL DESCRIPTION OF THE DRAWINGS

The presently preferred embodiment of the invention is disclosed in the following description and in the accompanying drawings, wherein:

FIG. 9 is a side elevational view of one of the lower grate holder arms only;

FIG. 11 is an enlarged sectional end elevational view showing the drive members in engaged driving position; and FIG. 12 is a similar view showing the drive members in disengaged position.

DETAILED DESCRIPTION

Figure 1:
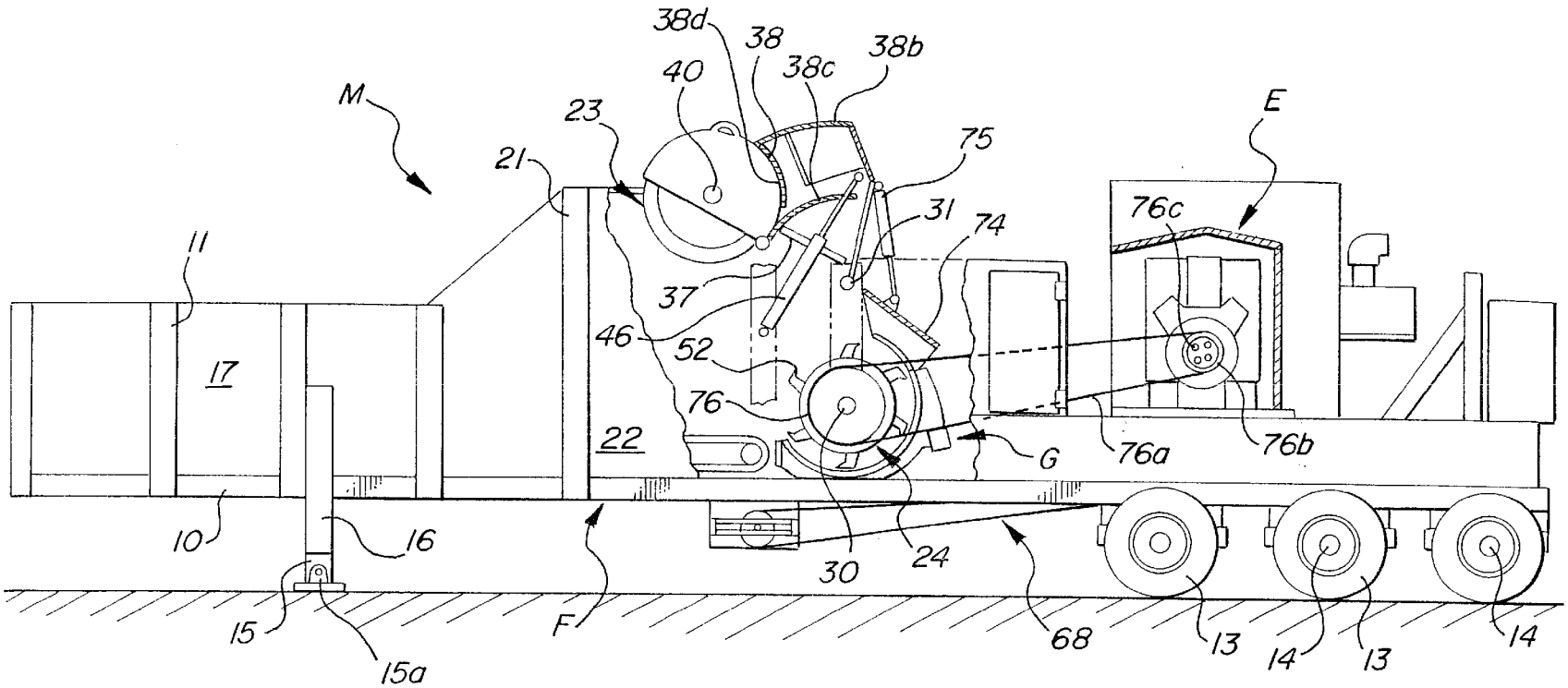
FIG. 1 is a schematic side elevational view of the machine with part of the near side wall broken away to show elements of the machine.
Figure 2:
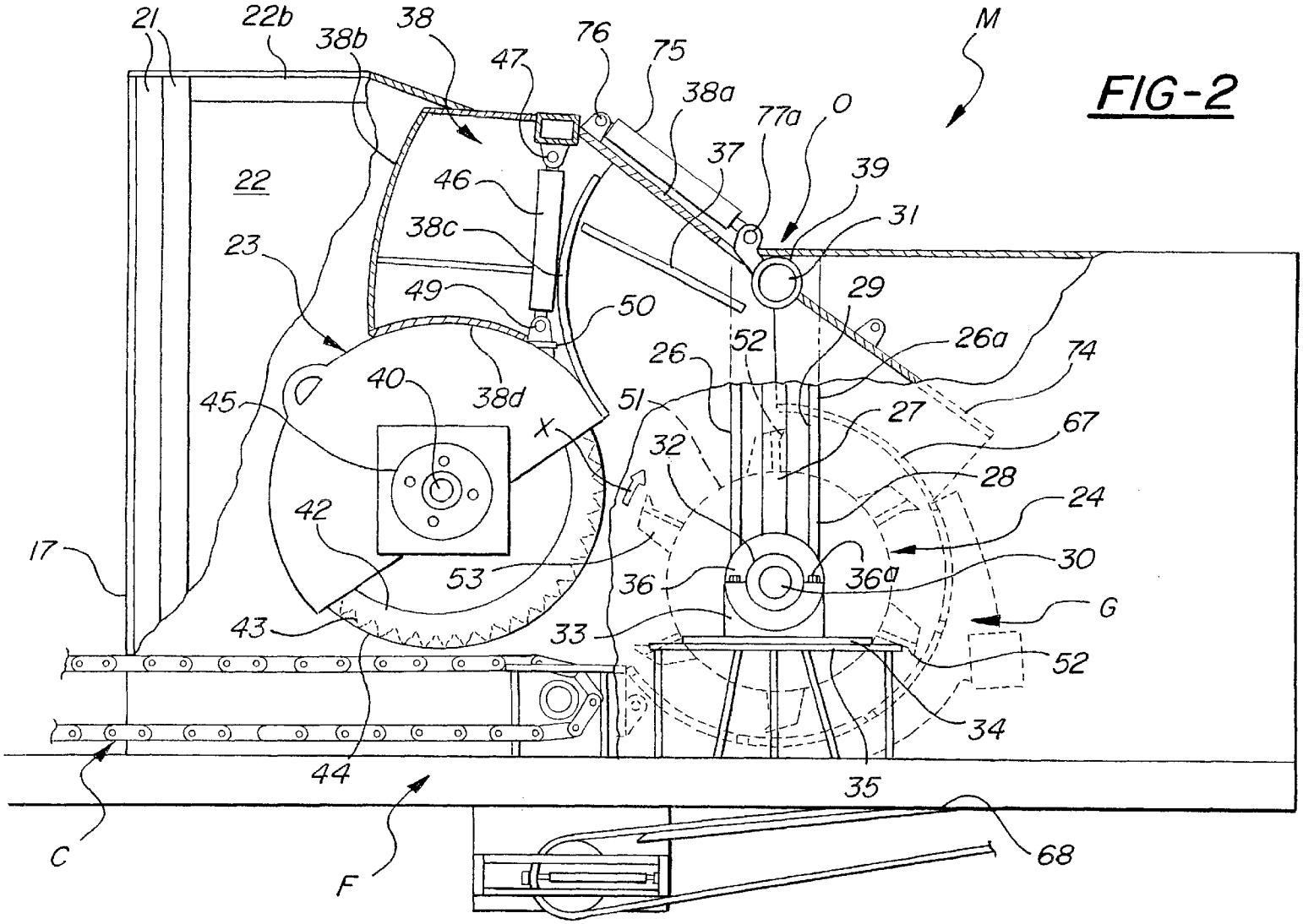
FIG. 2 is a partly sectional fragmentary schematic side elevational interior view on an enlarged scale showing the feed drum in down position.

Referring now, more particularly, to the accompanying drawings wherein a presently preferred embodiment of the invention is disclosed and directing attention initially to FIGS. 1 and 2, a letter M generally designates the wood processing machine which is shown as mounted on a trailer frame F which may be readily towed to the site of use, and which has a tow coupling mounted on one of its ends to facilitate coupling the machine to a towing vehicle. The trailer or machine frame F includes longitudinal channels or beams 10 and 10*a* connected by suitable cross beams or the like 11 at spaced intervals along the length of the machine. Wheels 12, with tires 13 thereon, are journaled on axles 14 carried by the frame F and vertically adjustable columns 15, with ground engaging pivotable plates 15*a* thereon, are movable in casings 16 secured to the frame F from a retracted position to an extended lowered position in which the support columns 15, in conjunction with the wheels 12, support the machine for operation in generally horizontal disposition.

At the front end of the machine, front and side walls 17 are provided to enclose a wood receiving conveyor system, generally designated C, which includes motor driven longitudinally extending endless chains 18, traveling over a floor plate 17*a* around front and rear sprockets 19 mounted on shafts 20 jounaled by the frame F. Material supporting, transversely extending bars or plates may be provided to connect the chains 18.

The walls 17 may be braced by suitable vertical stanchions 21. Upstanding side walls 22 and 22*a* are provided on the frame F rearwardly of the walls 17 to extend rearwardly therefrom to collectively house a material feed wheel, feed member, or drum, generally designated 23, and a wood shredding or fragmenting rotor or drum, generally designated 24. The conveyor 18 and the wheel 23, operating in conjunction, or either of them singularly, may be aptly termed a "feed works" for feeding material to be comminuted to the rotor drum 24 in a continuous longitudinal stream or flow of waste wood material.

The side walls of the machine, 22 and 22*a,* are supported by upper longitudinally extending beam members 22*b,* which connect to the upright side beams 21. Vertically slotted aligned openings O (FIG. 2) are provided in side walls 22 and 22*a* and vertical shaft and bearing support plates 27 and 28, which vertically abut at 29 are disposed in alignment with the openings O interiorly thereof. The lower plates 28, in FIG. 2, carry the comminuting drum drive shaft 30 and the plates 27 carry the feed drum pivot shaft 31 in a state of vertical alignment. Once the shafts 30 and 31 are inserted through the openings O at each side of the machine when plates 27 and 28 are lowered into position, the ends of the shaft 30 may be captured by shaft journaling bearings, generally designated 32, which comprise a lower half 33 supported on plates 34 and 35 carried by the side walls 22 and 22*a* of the machine M and upper bearing parts 36 which bolt to the lower bearing parts 33 as at 36*a*. Vertical retainer bars 26 and 26*a* bolt over the plates 27 and 28 to the side walls 22 and 22*a* to secure the plates 27 and 28 in fixed position. Suitable bearings (not shown) are also provided to journal shaft 31.

Figure 3:
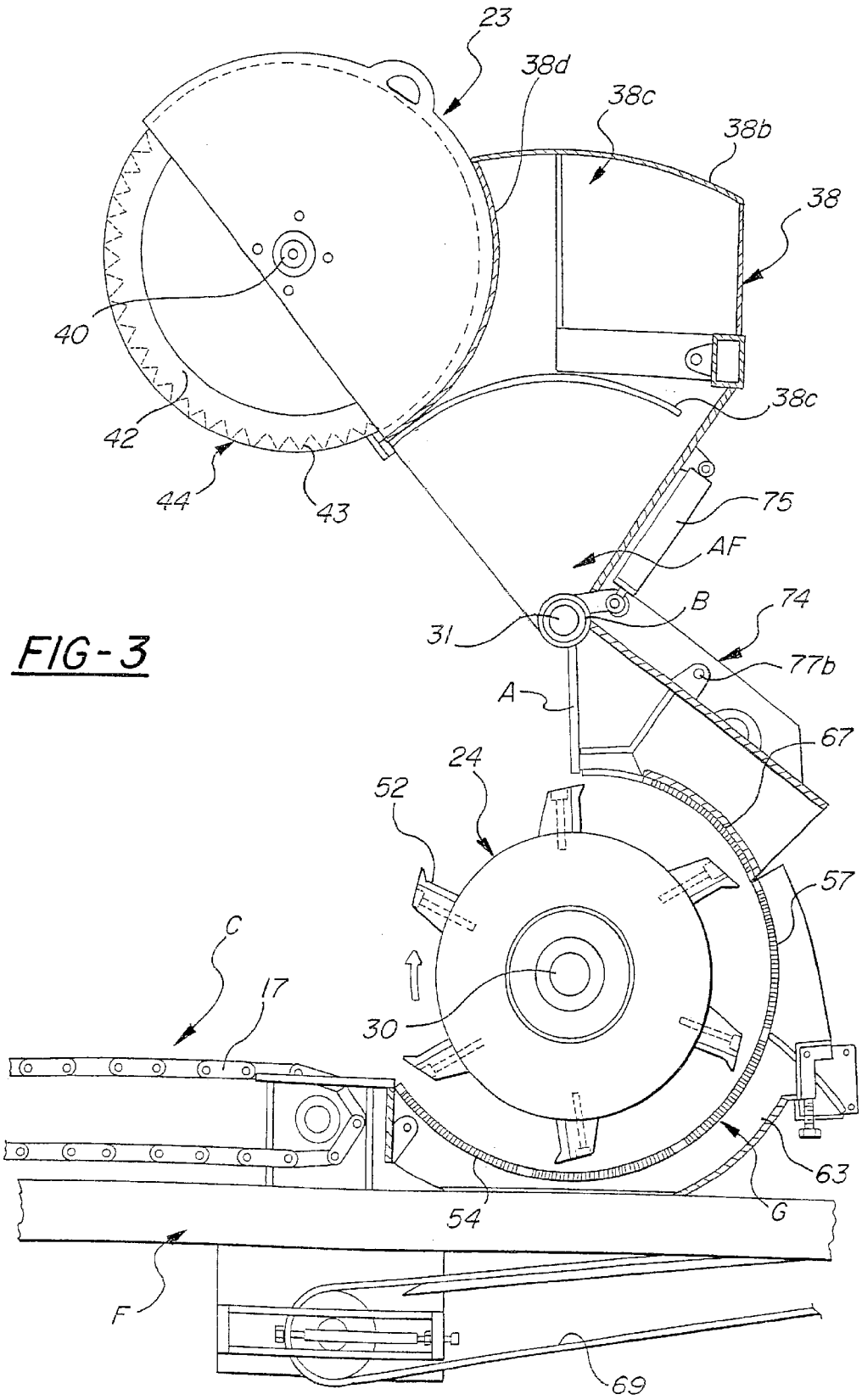
FIG. 3 is a similar view with the feed drum in raised position and with certain components omitted from the view for the sake of clarity.

The feed drum 23 is shown in lowered position in FIG. 2 and in raised position in FIG. 3. Feed drum side plate assemblies, generally designated 38, connected by arm portions or arms 38*a* to laterally spaced bushings 39, received on shaft 31, support the shaft 40 of feed drum 23 via bearings 41 provided on the side plate assemblies 38. The side plate assemblies 38 or support assemblies, which between them carry feed drum or feed member 23, include curved walls 38*b* and 38*c* which effectively span the arms 38*a* of the assemblies 38 which lie adjacent to side walls 22 and 22*a* and keep wood fragments from entering or leaving the comminuting region along the upper end of the feed drum or feed member 23 when it is in lowered operative position. A curved wall 38*d* connects walls 38*b* and 38*c* which may be referenced as lift arms. An anvil frame or anvil plate assembly AF, to which anvil A is fixed, is stationary when the machine is in operation and also mounts a top containment wall and material deflector plate 37 which normally is in fixed position. The frame AF which includes arms 37*a* fixed to wall 37 is fixed to bushings B which are pivotal on shaft 31 between the bushings 39 to permit anvil frame AF to pivot upwardly thereon when the machine is not in operation.

A feed drum shaft 40 (FIG. 2) has drum end plates 42, forming a part of assemblies 38, which support wood engaging and driving toothed members 43 constituting a peripheral drum surface as usual, generally designated 44. A suitable reversible rotary hydraulic motor, generally designated 45, and supported by one of the side plate assemblies 38 may be coupled to the shaft 40 for purposes of driving it in the direction indicated, or in the opposite direction of rotation. Double acting hydraulic cylinders 46 connected to the side plate assemblies 38 as at 47, and to a bracket 48 fixed on vertical frame stanchions 49 at 50, is utilized in moving the drum 23 from the position shown in FIG. 2 to the position in which it is shown in FIG. 3.

The cutting or chipping drum 24, which is shown as rotated in the uphill direction by the arrow x in FIG. 2, has a rotary drum periphery 51 extending from end to end of the drum 24 which includes a series of cutting teeth or comminuting members 52 in suitably spaced tool holders 53. For purposes of convenience, only several of the many laterally and circumferentially spaced teeth 52 are shown in the drawings.

Figure 4:
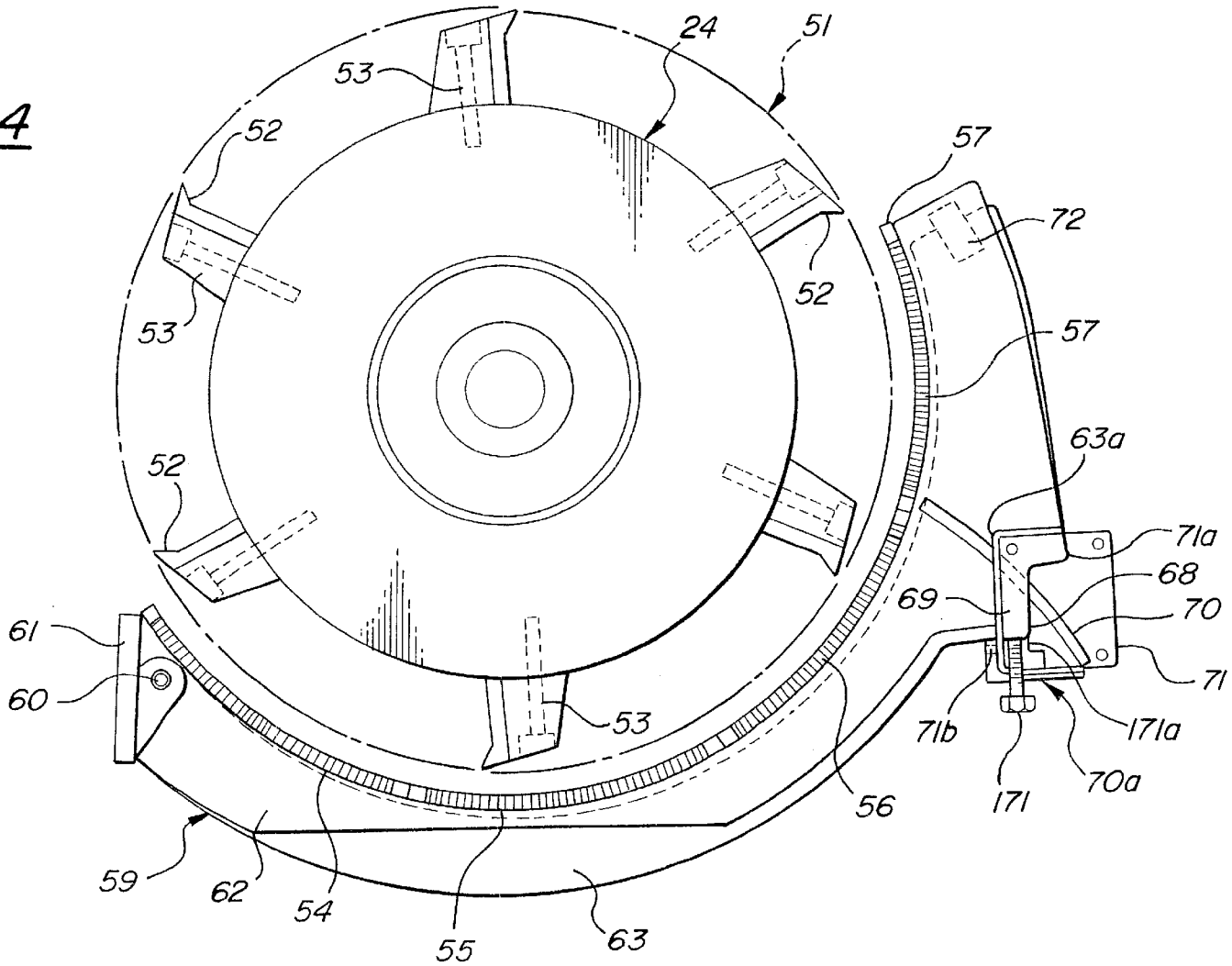
FIG. 4 is a still further enlarged fragmentary side elevational view of the comminuting drum and drum grate system only.
Figure 5:
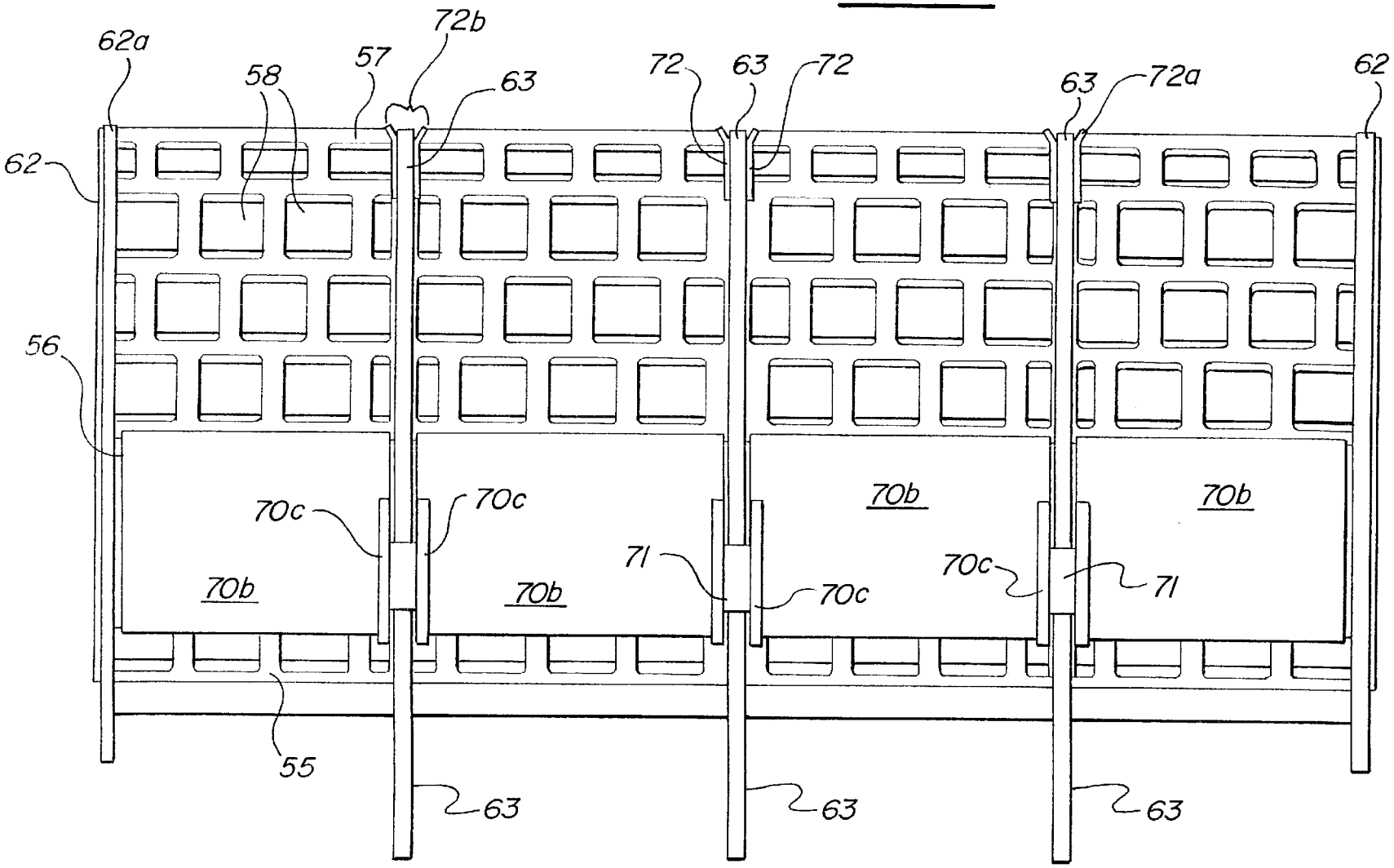
FIG. 5 is a greatly enlarged side elevational view of a portion of the grate and grate retainer system only.
Figure 6:
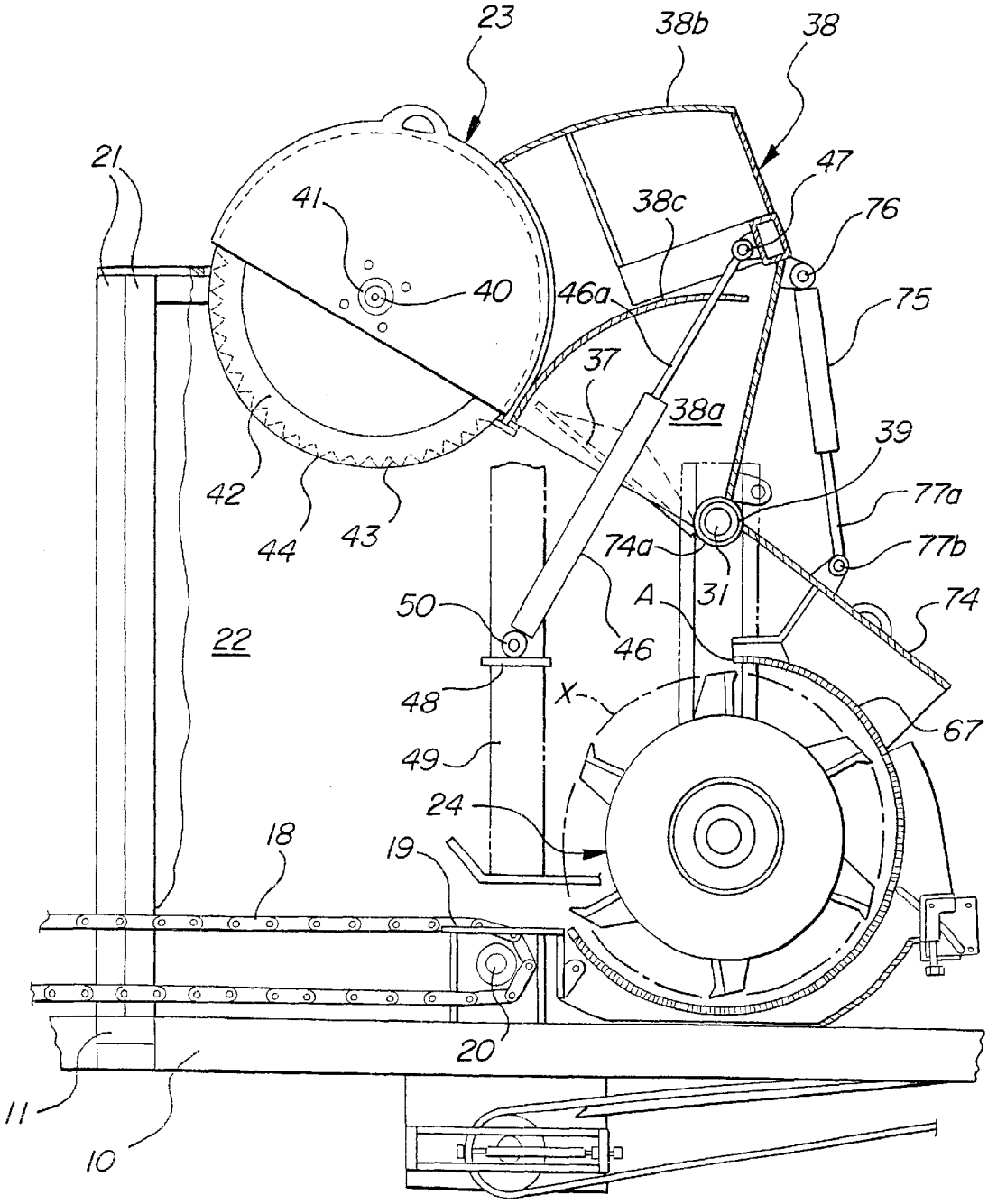
FIG. 6 is a view similar to FIG. 3 with the cylinder for lifting the upper grate retainer hood reconnected to the hood.

As FIGS. 2–8 particularly illustrate, the periphery of the cutting drum 24 is partly surrounded by perforate grate members 54, 55, 56, and 57 (FIG. 4), which, as FIG. 5 shows, are provided with grate openings 58. These grates 54–57, which all have the openings 58, extend lengthwisely or axially across the periphery of the drum, and are held in place by a grate retainer mechanism, generally designated 59 (FIGS. 4 and 5). The retainer mechanism has holding elements or arms 63 which pivotally mount at 60 to a frame F frame member 61. The mechanism 59 includes a pair of stationery end tracks 62, which embrace the ends of the grates 54–57 and are supported by frame members 61 upon side walls 22 and 22*a,* or in some other suitable manner. The intermediate clamp arms 63 (FIG. 5), which pivotally mount on shaft 60, are moveable sufficiently peripherally outwardly from the knife drum 54 to permit changing of the grates 54–57.

Figure 8:
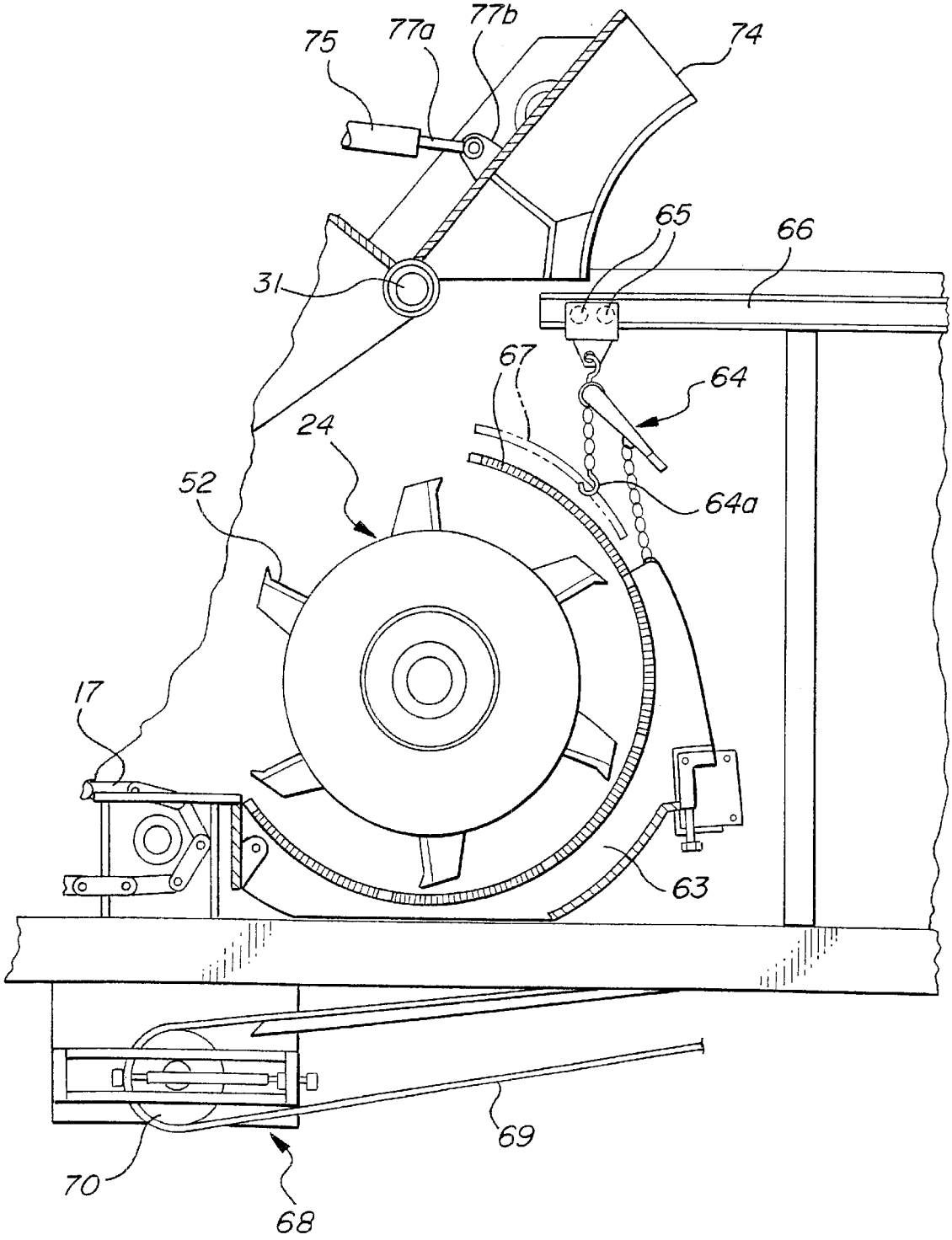
FIG. 8 is a similar schematic partly sectional fragmentary side elevational view illustrating elements used in the changing of the grate.

It is to be understood that the grates 54–57 are very heavy and typically are handled by a chain hoist device, generally designated 64, in FIG. 8. The chain hoist device 64 is moveable on rollers 65 along longitudinal tracks 66. The chain hoist device 64 is shown in FIG. 8 in the process of lifting an uppermost grate 67 having the same openings 58. Grate 67 is retained by an upper grate retainer device 74 forming a part of anvil frame AF, but also may be used to lift any of the grates 54–57 once the pivotal retainer arms 63 are released and swing outwardly sufficiently to clear the grates for upward sliding removal guided by fixed end supports 62 and curvilinear plates 70*b*.

Wood chips of the proper and desired size pass through the grate openings 58 and the various grates 54–57 and 67, and are removed by an underneath endless conveyor, generally designated 68. As shown, the chip take away conveyor 68 includes endless belts 69 trained around pulleys 70 in the usual manner and driven by motors powered by the engine E of the machine.

A laterally extending grate support member, generally designated 70*a,* which spans the grate assembly G and bolts to the frame side walls 22 and 22*a,* has blocks 71 with front edges cut away as at 71*a* to accommodate the stepped configuration 63*a* provided on each of the arms 63 (FIG. 9) and function as a stop, limiting radially outward swinging movement of the grate support arms 63. The curvilinear plates 70*b,* forming a part of the member 70*a,* extend to meet the marginal abutting edges of the grate plates 56 and 57.

The plates 70*b* have triangularly shaped gussets 70*c*. Bolts 171 extending through the blocks 71*b* and threaded through nuts 171*a* are adjustable to engage and hold the arms 63 in grate retaining position. The bolts 171 are backed off when it is desired to release the arms 63 to move outward and rest on nuts 171*a*. The curved plates 70*b* do not exert sufficient pressure on the grates to prevent withdrawal of the grates upwardly and function as grate supports. At their upper ends arms 63 have straps 72, with flared ends 72*a*, fixed to them for a purpose to be presently described.

Figure 7:
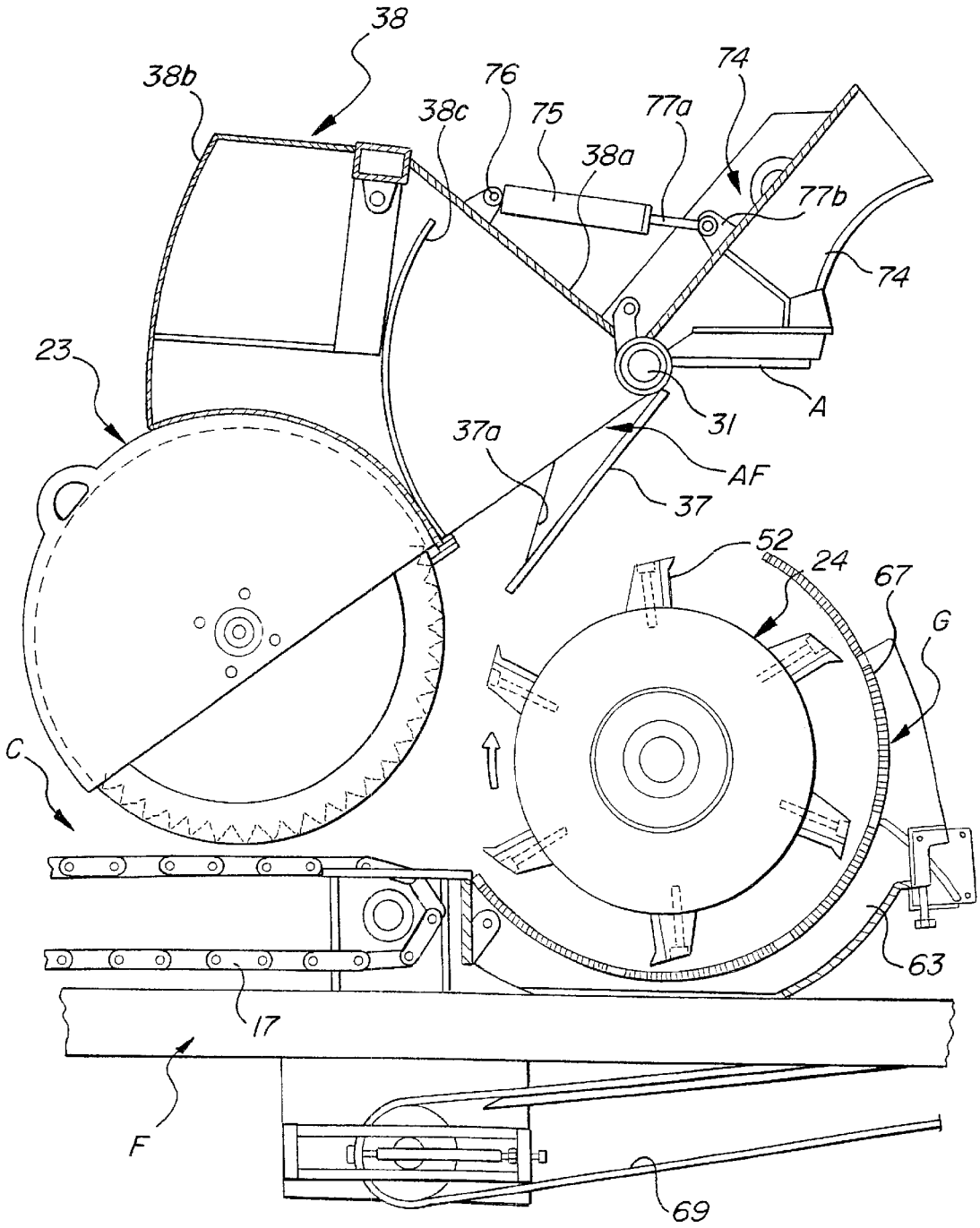
FIG. 7 is a partly sectional fragmentary schematic view similar to FIG. 6, but showing the feed drum in down position and the upper grate retainer hood raised, certain components being missing from the view.

As noted previously, the system also includes an upper grate 67, which is in abutting engagement with the plate 57, and is held in place by the anvil frame housing or hood member 74, which can be raised outwardly away from the position in which it is shown in FIG. 2 to the position shown in FIG. 7. It will be seen that a double acting hydraulic cylinder, generally designated 75 and pivotally received on a mount bracket 76 connected to the side plate assembly or housing 38, has a piston rod 77*a* normally inactively pivotally connected to a mount 78 on assemblies 38. Anvil frame AF, and hood 74 are mounted for pivotal movement on the shaft 31 by the sleeve or bushing members B, which interleave with the sleeve or bushing members 39 that mount the feed drum assembly 38 pivotally on the shaft 31. Guide members 72*b* on the hood 74 in alignment with arms 63 are received in and guide on the flared ends 72 on arms 63 when the hood 74 is in grate retaining position.

To remove grate retaining hood 74, the assembly or housing 38 is first moved to the raised position shown in FIG. 3 from the operative position shown in FIG. 2 by the double acting cylinders 46. When in this raised position, the piston rod 77*a* can be decoupled from the mount 75*a*, extended, and pivotally attached to a bracket 77*b* provided on housing 74 as shown in FIG. 7. With the system disclosed, lifting of the grate retaining housing or hood 74 is readily accomplished using the weight of the feed drum assembly 23 returning to operative position, the weight of plate 37, and cylinder 75 with its relocated piston 77*a*. Cylinder 75 later can control the restoration of the housing 74 to the closed grate embracing position when an upper grate 67 is restored to position. With the piston 77*a* in its maximum position of extension, the cylinder 75 and piston rod 77 initially function as a lever connected to the assembly 38 which causes the housing 74 to be initially lifted away from the grate 67 and then complete the final movement to the FIG. 7 position.

Figure 10:
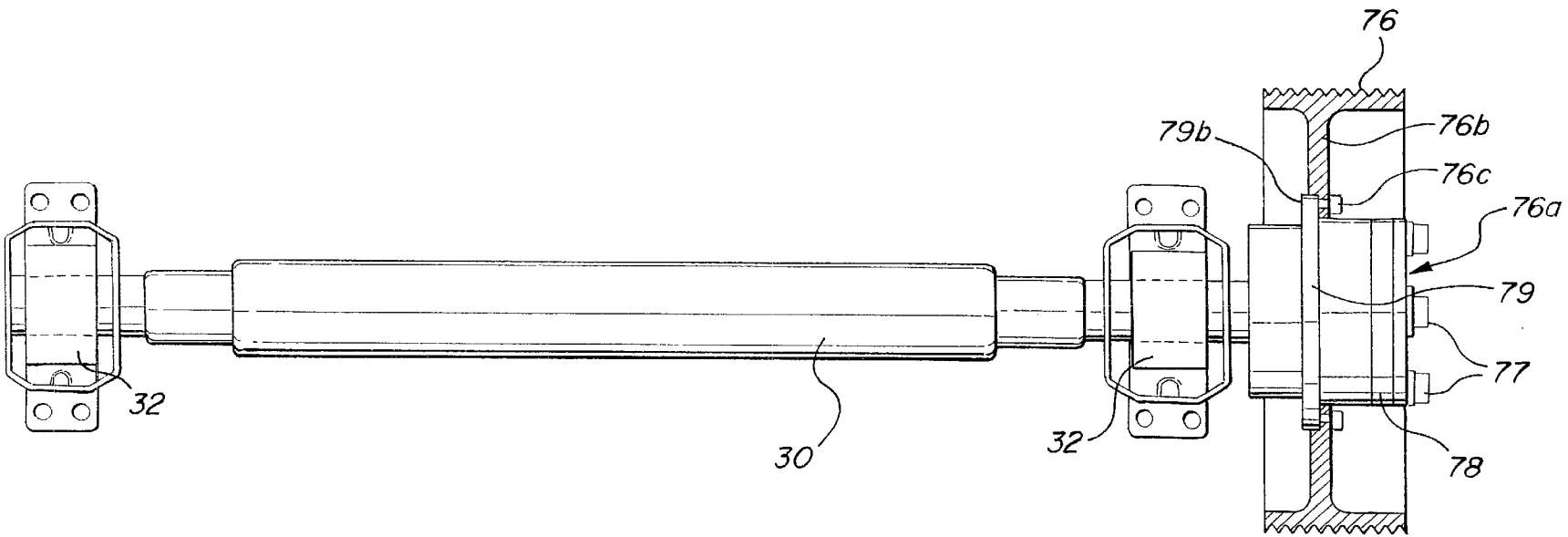
FIG. 10 is a partly sectional top plan view of the comminuting drum drive shaft assembly only.

The shaft 30 extends through one of the side walls 22 and 22*a* to be driven by a belt operated sheave 76 (FIG. 10) via a torque limiter device, generally designated 76*a*, which now will be described. The belt sheave 76 is driven appropriately by belts 76*a* connected with a drive 76*b* operated by the diesel engine E. The torque limiter 76*a* comprises a series of circumferentially spaced torque limiting devices, generally designated 77 (FIG. 11), which operate, under normal conditions, to couple a flange 78 keyed to shaft 30 to a flanged part 79 fixed to the sheave 76 but rotatable on shaft 30. Part 79 incorporates a drive disc 79*b* attached to sheave web 76*b* by bolts 76*c*.

To understand the operation of the torque limiting devices 77, attention is directed to FIG. 11 which shows the members 78 and 79 in engaged position and to FIG. 12 which shows them in disengaged position. Each of the six circumferentially spaced torque limiting devices which are utilized includes adjoining fittings 79*a* and 78*a* which are received within normally communicating openings 79*b* and 78*b* provided in the flanges 79 and 78, respectively. The fitting 79*a* is secured to the flange member 79 by a bolt member 81 and the fitting includes an enlarged recessed portion 82, which in the engaged (driving) position, receives a portion of a drive ball 83, which is retained in the bore 84 of the sleeve fitting 78*a*. A slideable plunger 85, extends into the sleeve fitting 78*a* from a torque limiter end housing portion 86, and it will be seen that the plunger 85 has an enlarged flange portion 87 inward of a ball accommodating valley or recess 89 with a sloped wall 90.

The plunger 85 is retained axially by means of a system of race forming members 91 and 92 acting on a circle of balls 94. The members 91 and 92 are loaded by the spring pressure of a spring, such as a coil spring 93. Screw member 95 threadingly engaged at 96 with the interior of housing bore 86 and alters the spring force as required for the torque limiting operation desired.

In a situation in which the cutting drum 24 should become jammed and not be free to rotate with the sheave flange 76*b*, the flange 79 will force each ball 83 to escape its socket 82 and cause each plunger 85 to be forced through each circle of balls 94, overcoming the spring loading on the angled races 91 and 92. Thus, the drive motor or engine for rotating the drum and the drum is protected without the necessity of the grates being disengaged when foreign matter is encountered in the wood fed to the machine. Typically for material jams between the grates and the rotating comminuting drum in such horizontally fed machines, the previous solution to the problem has been a disengageable grate which is forced to a disengaged position.

In the present machine once the foreign matter has been removed, the resetting of each torque limiter is a simple matter of first aligning the flanges 78 and 79 so that each ball 83 is opposite a cavity 82 and then pushing the plungers 85 toward the flanges 79 to permit each circle of balls 94 to return to original position. It is to be understood that the torque limiter described is a commercially available unit.

The Operation

In operation, the material to be comminuted is fed from the conveyor chains 18 to a position beneath the feed drum 23, which is in the position shown in FIG. 3. It will be raised upwardly as necessitated by the flow of material. The wood is advanced forwardly toward the comminuting drum 24 by the combined forwarding action of the conveyor chains 18 and the feed drum 23. Material processed forwardly by the conveyor chains and the drum 23 into the path of the teeth 52 on drum 24 is initially fragmented by the teeth 52 and moved upwardly between the drums 22 and 24 where it is contained by the deflecting surface or plate 37 which substantially spans the area between side walls 22 and 22*a* and extends to a position just short of the curvilinear shield 38*c*. With wall 37 remaining in fixed position regardless of the position of the feed drum 23 which moves upwardly and downwardly with the height of material being fed under feed drum 23, the deflection of material to the also fixed anvil A remains constant and controlled. The moving housing portion 38*c* contains the fragments of materials and deflects them toward plate 37 which directs them to pass beneath anvil A where they are further reduced or comminuted. Thereafter, if they are of sufficient size to pass through the grate openings in the overall grate G, they do so and, of course, the grate assists further fragmentation in view of the limited clearance, i.e. five-eighths of an inch, between the fixed teeth 52 on the rotating drum 24 and the grate G.

As indicated should a foreign non-fragmentable body become jammed between the grate G and the drum 24, the torque limiters will disengage the drive motor from drum 24 which is held stationery by the jammed condition. As indicated earlier, when the jammed condition is relieved and the flanges 78 and 79 restored to the engaged position of peripheral alignment shown in FIG. 11, the plungers 85 may simply be readily pressed inwardly to restore the balls 83 to an engaged position in which torque is transmitted once again to the drum 24.

To obtain access to the front portion of drum 24, cylinder 46 can be activated to swing the drum 23 from the position shown in FIG. 2 to the raised position shown in FIG. 3. In this position of the parts, it will be noted that cylinder 75 is inactively connected to bracket 75*a*. To remove the upper grate 67, which is retained by housing or hood 74, the piston rod 77*a,* of the cylinder 75, may be unhooked from brackets 75*a,* power extended, and reattached to bracket 77*b* provided on the hood member 74. Accordingly, when the cylinders 46 are operated to restore the feed drum 23 to operative position, the weight of this assembly will initially lift the frame AF and relatively heavy housing 74 from the position shown in FIG. 2 to a position in which it is partly removed from the grate 67, and with this momentum, piston rod 77 can then be retracted to complete the upward swing of retention hood 74.

The chain hoist 64, traveling on trolley 65, may then have its hook 64*a* extended through one of the openings in grate 67, which may then be lifted off as FIG. 8 indicates is occurring. The grate sections 54–57 may be removed by sliding them upwardly, once the retainer arm members 63 are released by backing off bolts 71 and swung outwardly to rest the on stepped members provided on member 70*a*. Hooks 64*a,* are also employed, in this further removal of the heavy grate sections.

The disclosed embodiment is representative of a presently preferred form of the invention, but is intended to be illustrative rather than definitive thereof. The invention is defined in the claims.

We claim:

1. A method of controlling a generally horizontal wood material comminuting machine having a generally longitudinally disposed frame with spaced apart side walls having front and rear ends, a crosswisely extending rotatably mounted rotor shaft having a rotor with a periphery comprising comminuting members movable with said rotor in a path of rotation, a crosswisely extending anvil carried on said frame to coact with said comminuting members and reduce said material, a drive for moving said rotor shaft and rotor in a path of rotation past said material support surface, a feed works connected with said frame in front of said rotor including a power-driven feed member having a generally horizontal axis extending generally parallel to said rotor axis mounted above said support surface, support arms pivoted on said frame rearwardly of said feed member pivotally carrying said feed member for swinging vertical movement toward and away from said material support surface, and a grate assembly downstream from said anvil supported by said frame adjacent said path of comminuter rotation to embrace a portion of said rotor path downstream from said anvil, including:

a. providing a disengagable torque limiting device; and b. connecting said device between a drive sheave at one end of said rotor shaft and a plate fixed on said rotor shaft, said torque limiting device comprising a series of ball receiving circumferentially spaced wells in one of said plate and sheave, and a series of balls urged normally by spring-pressed plunger members partly into said wells in shaft driving position, there being plunger housings carried by the other of said plate and sheave in which said plungers are slideable between an operative position maintaining said balls in shaft driving position in said wells and an inoperative position in which said plungers are forced to an inoperative position by said balls to disengage said drive from said plate and rotor shaft when said rotor shaft is prevented from rotating by foreign material jams.

2. A generally horizontal wood material comminuting machine comprising:

a. a generally longitudinal frame with front and rear ends and spaced apart side walls;

b. a transversely extending rotatably mounted rotor shaft comprising a rotor with a periphery of comminuting members moving in a path of rotation;

c. an anvil plate assembly including a transversely extending anvil pivotally carried on said frame above said rotor shaft to coact with said comminuting members in reducing said material;

d. a feed works connected with said frame forwardly of said rotor including a material support surface on which said material is supported and a power-driven feed member having a generally horizontal axis extending generally parallel to said rotor axis mounted above said support surface for engaging said material and feeding it along said support surface towards said rotor;

e. a drive for moving said rotor shaft and rotor in an uphill path of rotation upwardly past said material supply surface;

f. supports pivoted on said frame rearwardly of said feed member carrying said feed member for swinging vertical movement toward and away from said material support surface;

g. a grate assembly downstream from said anvil comprising a series of crosswisely extending curvilinear grate plates supported by said frame adjacent said path of comminuter rotation and including an upper grate; and h. a grate retainer housing fixed to said anvil plate for pivotal movement therewith releasably holding said upper grate in position when said anvil is in operative position.

3. The machine of claim 2 wherein said anvil operatively comprises a generally vertically disposed plate and a disengageable link is provided which is connectable between said supports and said anvil plate assembly when said feed member is in a raised position to permit the weight of the descending feed member to assist swinging of said anvil plate and grate retainer housing to a raised inoperative position.

4. The machine of claim 3 wherein said link includes a fluid pressure operated cylinder which is actuatable to assist said swinging movement of said anvil plate and grate retainer housing to raised inoperative position and to control return swinging to operative position.

5. A method of operating a generally horizontal wood comminuting machine having a generally longitudinally disposed frame with front and rear ends and spaced apart side walls, a crosswisely extending rotatably mounted rotor shaft on said frame mounting a rotor having a periphery comprising comminuting members movable in a path of rotation, a crosswisely extending anvil plate carried on said frame above said rotor shaft to coact with said comminuting members in reducing said material movable from a generally vertical operative position to a raised position, a feed works connected with said frame forwardly of said rotor including a material support surface on which said material is supported and a power-driven feed roll member having a generally horizontal axis extending generally parallel to said rotor axis mounted above said support surface for feeding material along said support surface towards said rotor, a drive for moving said rotor shaft and rotor in an uphill path of rotation upwardly past said material support surface, a support assembly pivoted on said frame rearwardly of said feed roll member pivotally carrying said feed roll member for swinging vertical movement toward and away from said material support surface, a grate assembly downstream from said anvil comprising a series of crosswisely extending curvilinear grate plates supported by said frame adjacent said path of comminuter rotation and including an upper grate, a grate retainer housing for releasably holding said upper grate in operative position fixed to said anvil to pivot therewith, and a link carried by one of said feed member support assembly and said anvil plate and grate retainer assembly which is connectable between them, comprising:

a. raising said feed member roll to an upper position;

b. connecting said link disengageably between said support assembly and said anvil plate and retainer housing assembly; and c. lowering said feed member roll from raised position to permit its weight to assist swinging movement of said anvil plate upwardly to inoperative position and said retainer housing upwardly to an inoperative position permitting removal of said upper grate.

6. The method of claim 5 wherein said link is provided as a double-acting fluid pressure actuated cylinder and said cylinder is actuated to assist in raising said anvil plate and retainer housing and in controlling its descent to operative position.

* * * * *